United States Patent [19]

Stock

[11] 4,173,241

[45] Nov. 6, 1979

[54] GOLF CLUB WOOD HOLDER

[76] Inventor: Herman E. Stock, P.O. Box 1718, Pompano Beach, Fla. 33061

[21] Appl. No.: 875,133

[22] Filed: Feb. 6, 1978

[51] Int. Cl.[2] ..... A63B 65/00

[52] U.S. Cl. ..... 150/1.5 R; 150/52 G

[58] Field of Search ..... 150/1.5 R, 1.5 B, 1.5 C, 150/52 G

[56] References Cited

U.S. PATENT DOCUMENTS

| | | | |
|---|---|---|---|
| 2,704,563 | 3/1955 | Henrich | 150/1.5 R |
| 2,752,973 | 7/1956 | Stamp | 150/1.5 R |
| 2,879,819 | 3/1959 | Turnbull | 150/1.5 R |
| 3,053,298 | 9/1962 | Stamp | 150/1.5 R |

*Primary Examiner*—Donald F. Norton

*Attorney, Agent, or Firm*—Barry L. Haley; Eugene F. Malin

[57] ABSTRACT

A device for protectively housing up to four golf club woods which allows for easy access, removal, and replacement of each golf club wood and easy identification of a particular wood in a protective enclosure when the club is not in use. The device includes a premolded plastic or rubber compartmentalized housing, shaped somewhat like a cloverleaf having separated, equally sized compartments, each compartment contoured in shape to receive and support a full-sized, inverted golf club wood head. Each compartment has at its base, a passage for receiving a shaft encompassing tube, the tube being frictionally attached at one end within the compartment passage. The tubes act to support the device in a vertical position and are sized in length equally and cut such that the length of each tube is slightly greater than the length of the longest club shaft utilized. A resilient cover is disposed over the top of the housing to protect the clubs when not in use. The individual club head receiving compartments include pads to prevent scarring or damage to the club head when disposed in the housing or during removal or insertion. Ventilation apertures are also provided.

1 Claim, 3 Drawing Figures

GOLF CLUB WOOD HOLDER

BACKGROUND OF THE INVENTION

This invention relates generally to a protective device for housing golf club woods, which also serves as an organizer to readily separate each individual wood for rapid identification, and specifically to a device that receives and groups one or more golf club woods, the device being receivable within a golf bag or utilized separately therefrom, for protectively housing individual golf club woods conventionally used in the game of golf.

In the past, it has been customary to provide individual golf club wood covers (one for each golf club wood) which would be removed to play a shot and then replaced back on the head of the club. Often times, an individual cover would be lost since it is individually removed and replaced each time a different club is used. Also, an individual cover could be placed on the wrong club which would increase the probability of error in selecting the wrong club during play.

The present invention overcomes these problems by providing a protective device which shields the individual woods from contacting other clubs when not in play while still allowing rapid visual identification and organization of each wood so that a player can readily select the proper club. The housing body is resilient. The hood or cover (which covers all woods simultaneously) is sized to hold the outer perimeter portions of the housing inwardly to somewhat overlap each wood for greater protection which acts to hold the woods from moving vertically when housed with the cover in place.

The device may be readily constructed at reduced cost since each of the parts may be formed using mass production molding or extruding techniques.

BRIEF DESCRIPTION OF THE INVENTION

A device for protectively housing and organizing one or more golf club woods comprising a resilient housing, said housing having a plurality of symmetrically shaped compartments, each compartment of which is formed in the contour of the upper head surface of a golf club wood, the housing being formed in a cloverleaf-like array with each compartment having a passage located at its base.

A cylindrical tube is connected at one end within each of the compartment passages, the plurality of tubes forming a vertical support for the device. The tubes are cut of equal length, the length being determined by being slightly longer than the length of the longest club shaft. Thus, when the clubs are housed in the device, they will in effect be held by gravity in a dangling position. Since each tube is of identical length, the plurality of tubes then may act as a rigid vertical support for the entire device.

Within each compartment in the housing (which in the preferred embodiment would be quadrants for separating four golf club woods), a cushion or pad is placed providing a resilient surface where the upper club head surface rests (inverted) on the cushion to prevent scarring or damage to the club surface. Barrier walls are provided on the inside of the housing which segregates each compartment, each wall terminating radially in a central position of the housing.

A circular, resilient or stretchable cover is included which fits over the open top of the housing, sheltering all of the clubs inside. The diameter of the cover is smaller than the diameter of the housing. The cover may be constructed of a transparent plastic to allow visual observation of the club heads with the cover installed.

The cover has a peripheral, annular lip which engages the outside perimeter portions of the housing at each compartment perimeter which causes the resilient housing edges to fold inwardly under tension when the cover is in place. This allows for the housing to engage the upper portion of the inverted club head to prevent vertical movement of the club when it is within the housing with the cover installed. The flexible structure of the cover allows it to be readily removed or installed over the housing. Once the cover is removed, such as during the game of golf, the base plate of each of the woods is exposed in such a position as to be easily identified by the golfer, while the housing still maintains separation between each of the clubs. In one embodiment, the housing may be molded from a rubber or resilient plastic material with the pads or cushions coupled to the compartment interior by a suitable adhesive. The tubes are cylindrically shaped and are frictionally coupled within the compartment passages. Each tube diameter is slightly larger than the diameter of the passage to insure a firm frictional engagement.

It is an object of this invention to provide an improved golf club wood protective device.

It is another object of this invention to provide a golf club holder for use with golf club woods which provides for a protective enclosure for each of the woods while allowing for rapid visual identification of a particular club during the playing of the game.

And yet, still another object of this invention is to provide a golf club storage device which may be fabricated at reduced cost by molding technique.

And yet, still another object of this invention is to provide a golf club holder which may be readily sized to accommodate different shaft length for individual golfers.

In accordance with these and other objects which will be apparent hereinafter, the instant invention will now be described with particular reference to the accompanying drawings.

PREFERRED EMBODIMENT OF THE INVENTION

Figure 1:
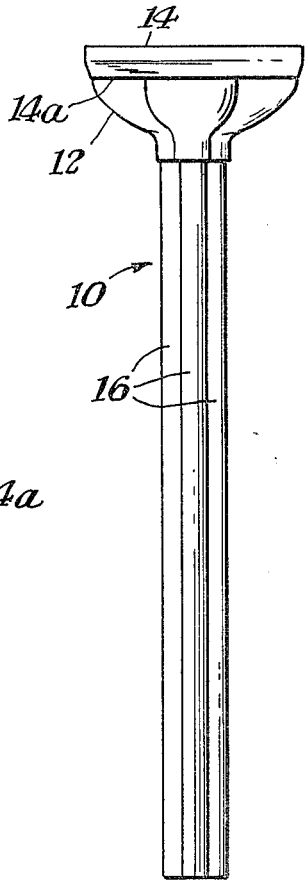
FIG. 1 shows a side elevational view of the instant invention with the cover attached.

Referring now to the drawings and specifically FIG. 1, the instant invention is shown generally at 10 comprised of a preformed cloverleaf-shaped housing 12 having a resilient cover 14 disposed and a plurality of tubes 16 connected to the base of the housing. The tubes 16 are cut of equal lengths and act as a rigid vertical support.

Figure 2:
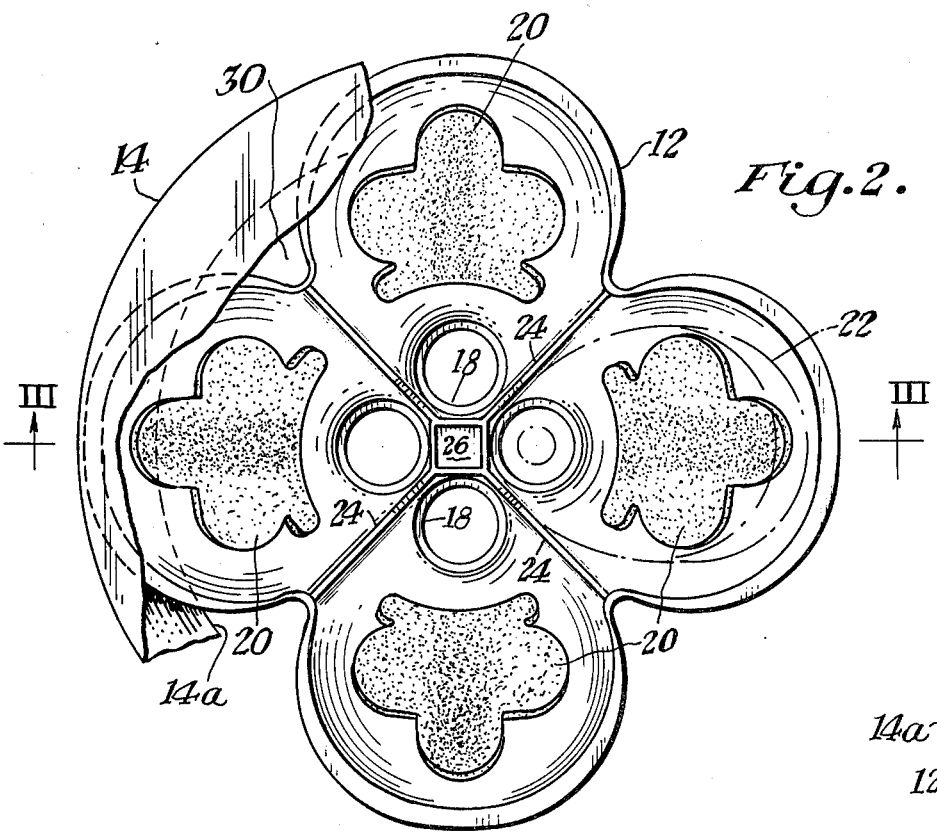
FIG. 2 shows a top plan view of the instant invention with a fragmentary portion of the cover attached thereto.

Referring now to FIG. 2, the housing 12 is shown which includes substantially four compartments, each of which is shaped to accommodate the upper surface of a golf club wood, with a plurality of barrier walls 24 separating each of the compartments terminating at the center 26 in a base portion of the housing. Each compartment has an annular passage 18 at the base of the housing which receives tube 16 (FIG. 3) into the passage which allows for the insertion of the grip and shaft of the golf club to place and dispose the club upside down within each compartment. Each club rests on a pad or cushion 20 disposed within each compartment which may be of a light styrofoam material or the like to prevent scratching or marring of the club surface, especially during removal or reinsertion into the club holder. With the cover 14 removed, it is understood that each club is readily identified by the club head bottom plate (not shown) which would be facing upward showing the club number so that one can readily identify the specific club selected. If, while playing, the situation demanded, the cover 14 may be placed over the clubs after each wood is used or at the end of the golf game. The cover may be constructed of a clear, transparent plastic so that the woods in the housing can be observed with the cover installed.

Figure 3:
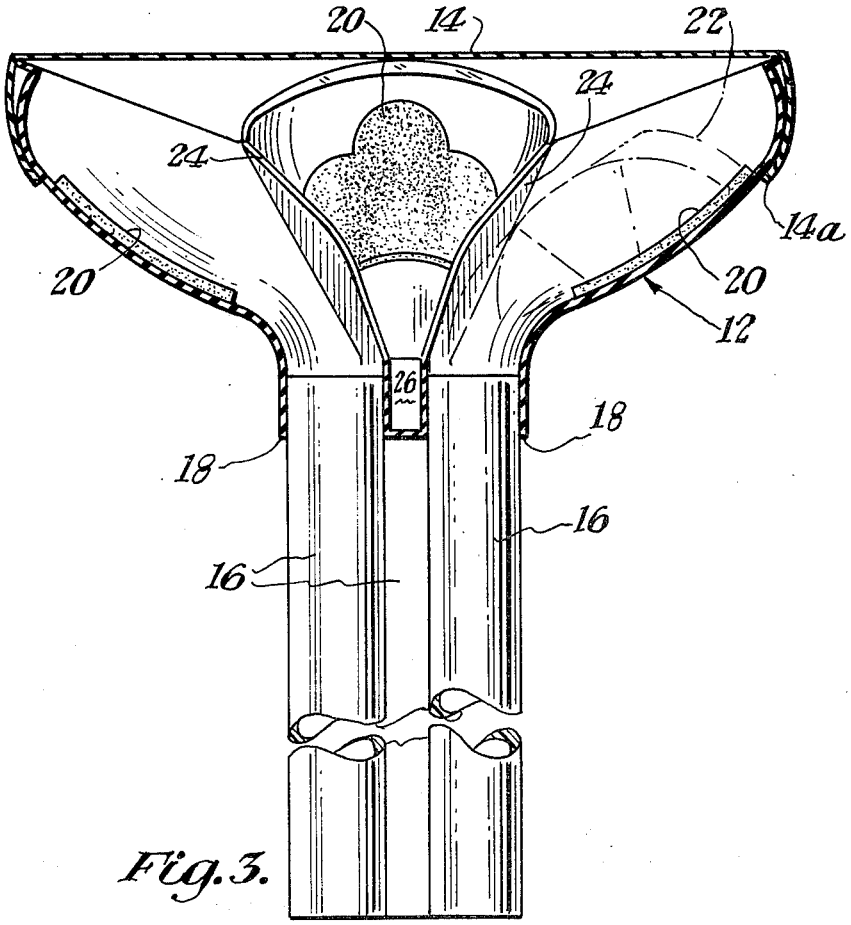
FIG. 3 shows a side elevational view partially in cross-section of the instant invention.

The resilient cover or hood 14 as shown in FIG. 3, has a peripheral lip 14*a* of a diameter smaller than the distance across opposing compartments which engages the outer perimeter portions of the housing 12 causing the upper perimeter portions to bend inwardly since the diameter of the cover 14 is constructed smaller than the outer perimeter distances across the top of the housing. This inward folding of the housing perimeter causes engagement on a club positioned within a particular compartment to resist or prevent vertical movement of the club, holding it more firmly within the housing itself. Thus, the folding over prevents looseness or movement and possible frictional wear of each head during travel or storage. Also, each compartment is sized to be larger than the largest golf wood head to permit easy removal or installation of an individual golf club.

Another improvement offered in the present invention is that through the use of the cloverleaf-shaped housing 12 which has separate compartments, a ventilation aperture 30 is achieved between each compartment and the cover lip 14*a* when in place. Ventilation of the housing allows for woods contained therein to receive air for fast drying which will prevent swelling, contraction, distortion or separating of the wood head on the club should the club be used during rainy conditions. The ventilation provided by the apertures 30 formed between adjacent compartment exterior surfaces allows for air flow over the surfaces of the wood head for the woods maintained therein. The annular lip 14*a* on the cover forms the third side of the air aperture 30 in conjunction with adjacent compartment surfaces. Thus, with the cover 14 installed, the device provides for rain protection while still allowing full ventilation for rapid drying of the clubs.

In addition, the cover lip 14*a* may include an elastisized band (not shown) to more firmly grip the housing.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An improved golf club holder and divider for protectively housing golf club woods, comprising:

a resilient pre-molded housing, said housing having an upper open portion and a plurality of integrally formed compartments, each of which is shaped to contour to the upper face of a golf club wood, each compartment having a passage disposed near the base of the compartment, said passages being adjacent each other;

a plurality of tubes, each of which is connected into a different base passage, said tubes being sized slightly longer than the length of the longest golf club shaft of a particular user; and a resilient cushion, said cushion being disposed in each of said compartments of said housing for engaging the upper surface of the golf club wood resilient stretchable cover, sized to engage the upper opening of said housing, said cover being diametrically smaller than the diametrical distance across the housing at least one ventilation aperture formed with said cover installed between said cover and adjacent compartments.

* * * * *